United States Patent [19]

Donatelli

[11] Patent Number: 4,509,302

[45] Date of Patent: Apr. 9, 1985

[54] BUILDING STRUCTURE

[76] Inventor: Eugene R. Donatelli, 660 Taconic Trail, Williamstown, Mass. 01267

[21] Appl. No.: 424,007

[22] Filed: Sep. 27, 1982

[51] Int. Cl.[3] ..... E04B 7/00

[52] U.S. Cl. ..... 52/82

[58] Field of Search ..... 52/82, 75, 78

[56] References Cited

U.S. PATENT DOCUMENTS

| | | | |
|---|---|---|---|
| D. 170,843 | 11/1953 | White | 52/78 |
| 3,402,516 | 9/1968 | Kanarr | 52/75 |
| 3,513,608 | 5/1970 | Nagrod | 52/82 |
| 3,727,355 | 4/1973 | Vachon | 52/82 |
| 3,919,813 | 11/1975 | Beindorf | 52/80 |
| 4,012,867 | 3/1977 | Lainchbury | 52/86 |
| 4,026,077 | 5/1977 | Pickett | 52/80 |

FOREIGN PATENT DOCUMENTS

| | | | |
|---|---|---|---|
| 2146286 | 3/1973 | Fed. Rep. of Germany | 52/80 |
| 1215175 | 4/1960 | France | 52/80 |

*Primary Examiner*—Donald G. Kelly
*Assistant Examiner*—Michael Safavi
*Attorney, Agent, or Firm*—Sidney Greenberg

[57] ABSTRACT

Greenhouse, solarium or the like has roof and side walls comprising a plurality of panels formed of stiff, outwardly bowed light transmitting sheets arranged adjacent one another in substantially radial array, and elongated spaced framing members extending along the adjacent sides of the panels holding the panels in bowed condition in the array.

4 Claims, 4 Drawing Figures

BUILDING STRUCTURE

The present invention relates to building structures and more particularly to structures suitable for use as a greenhouse, solarium or the like.

It is an object of the invention to provide a structure of the above type which has a high strength to weight ratio and an improved capability of withstanding the load effects of weather such as winds, ice and snow.

It is a particular object of the invention to provide a light transmitting enclosure of the above type which facilitates the passage of the sun's rays into the enclosure and thereby increases the amount of sunlight and heat collected within the enclosure.

Another object of the invention is to provide a structure of the above type which is simple in construction, economical to manufacture, and easy to erect.

Still another object of the invention is to provide a structure of the above type which may be constructed in a variety of shapes and sizes, and is aesthetically pleasing in appearance.

Other objects and advantages will become apparent from the following description and the appended claims.

With the above objects in view, the present invention in one of its aspects relates to a building structure comprising, in combination, a plurality of panels formed of stiff, outwardly bowed, light transmitting sheet members arranged adjacent one another in radial array, and elongated spaced framing members extending along the adjacent sides of the panels holding the panels in bowed condition in the array.

In a typical structure, the building is a circular greenhouse or the like having a sloping roof constituted by the above described combination of bowed light transmitting panels and intervening framing members in circular array, and having a side wall comprising a combination of vertically arranged, outwardly bowed, light transmitting panels with intervening framing members likewise extending in circular array below the roof.

The invention will be better understood from the following description taken in conjunction with the accompanying drawing, in which.

Figure 1:
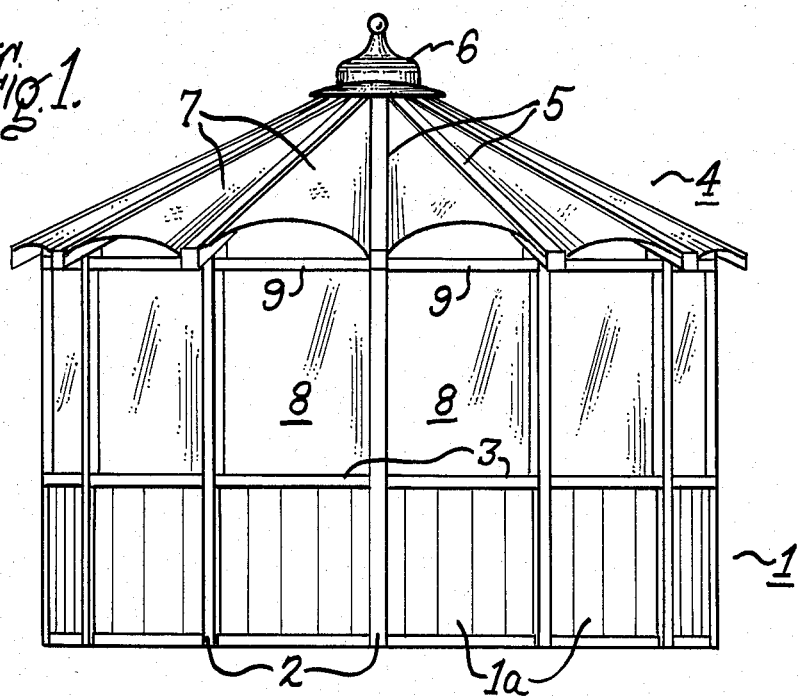
FIG. 1 is an elevational view of a greenhouse, solarium or the like in which the invention is embodied.
Figure 2:
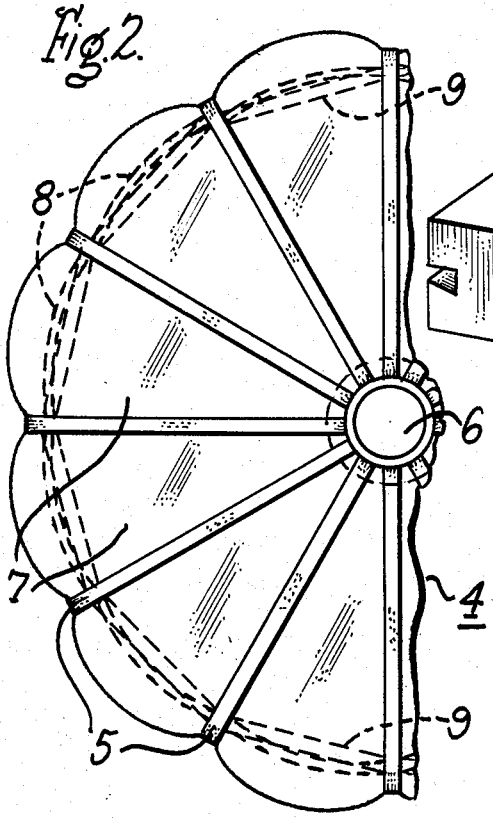
FIG. 2 is a top plan view of a portion of the building structure shown in FIG. 1.

Referring now to the drawing, and particularly to FIG. 1, there is shown a circular greenhouse or the like forming an enclosure and comprising a lower side wall 1 formed of a circular array of wood panels 1*a* with uniformly spaced posts or columns 2 extending upwardly therefrom and braced by horizontal stringers 3 extending along the top of the lower side wall and stringers 9 connecting the upper ends of posts 2. Arranged at the top of posts 2 is downwardly sloping roof 4 comprising beams or framing members 5 in radial array with their inner ends secured to hub 6 and their outer ends suitably attached to the top ends of support posts 2, such that roof 4 overhangs side wall 1.

In accordance with the invention, roof 4 comprises a plurality of light transmitting panels 7 typically formed of stiff, flexible plastic sheets such as acrylate plastic material, each panel 7, which is generally triangular in flat form, being held between adjacent framing members 5 in an upwardly bowed configuration so as to be convex along its length as viewed from above the structure. Preferably, the degree of curvature, as measured by the radius of curvature, varies from one end to the other, but curvatures which are the same along the length of the panel are within the scope of the invention.

Figure 3:
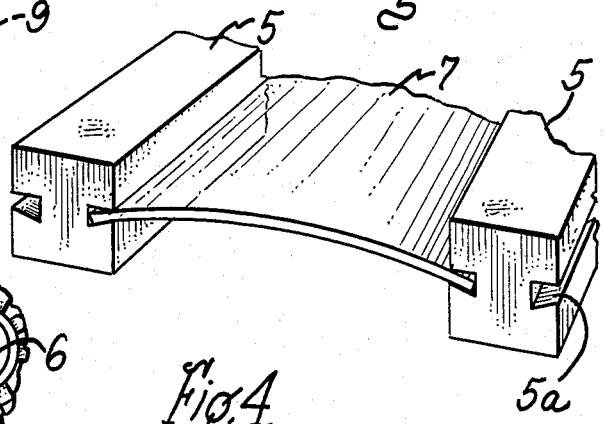
FIG. 3 is a perspective view of a detail of the FIG. 1 structure showing a bowed light transmitting panel supported by adjacent framing members in accordance with the invention.
Figure 4:
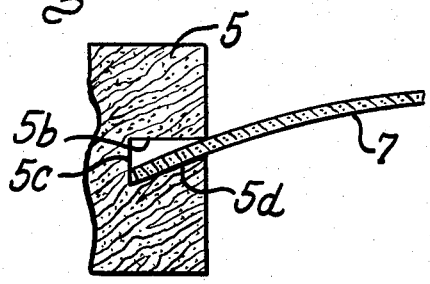
FIG. 4 is a cross-sectional view of the joint between the bowed light transmitting panel and the supporting framing member.

In the illustrated embodiment, as seen best in FIGS. 3 and 4, framing members 5 are formed along opposite side edges with grooves 5*a*, the framing members in the assembly being arranged so that the grooved side edges of adjacent framing members face each other. Each groove 5*a* is defined by an upper horizontal surface 5*b*, a vertical surface 5*c*, and a lower surface 5*d* angled relative to upper surface 5*b* as shown, the groove being so proportioned that the inserted edge of the panel engages surface 5*c*, rests on angled surface 5*d*, and is in contact with the upper surface 5*b*, being thereby held in firm attachment to and in substantial sealing relation with the adjacent framing members 5 and held therebetween in the desired bowed configuration, as depicted in FIG. 3.

In a usual case, the openings in the sides of the structure defined by stringers 3 and 9 and posts 2 are covered by similarly outwardly bowed plastic sheets or panels 8 which normally are formed from rectangular sheets and have the same curvature from top to bottom. Side wall panels 8 are typically held in bowed condition by insertion in grooves formed in posts 2 similarly to the grooved arrangement described above in connection with the roof panels.

In a typical construction, the sheet material forming the roof panels is about $\frac{1}{8}$ inch in thickness where the wide (lower) end of the panels is about 3 feet wide. Where wider or narrower panel widths are employed, the sheet thickness would correspondingly be thicker or thinner. The longer the radius of curvature at the wide end of the panel, the thicker the sheet usually employed. For a sheet of $\frac{1}{8}$ inch thickness, a practical radius of curvature at the wide end is about 22 inches, and at the other end about 45 inches.

The described structural arrangement provides a number of advantages and benefits. By virtue of being held in upwardly bowed condition as shown, roof panels 7 are characterized by high strength to weight ratios, as compared to flat sheets or panels, thereby having the capability of withstanding even severe stresses imposed by weather conditions, such as high winds and the weight of accumulated snow and ice on the roof. Of particular importance in the case of greenhouses or solaria thus constructed, the amount of sunlight and heat collected within the enclosed structure is markedly increased. As is well understood, the amount of light which passes through a transparent sheet depends on the angle at which the light strikes the surface, and the closer the angle of incidence of the light rays is to a line perpendicular to the surface, the greater the amount of light which passes through the sheet.

In the described arrangement, each of the roof panels is positioned at an angle with respect to the horizon as well as radially, and these features coupled with the convex shape of the panels provide for some portions of the roof panels to be always normal to the sun's rays as the sun changes position daily and seasonally relative to any one geographical location. As a result, more sunlight passes through the roof into the interior of the enclosure over a given period of time, and more heat is consequently collected therein. Increased heat is produced not only due to increased amounts of sunlight passing through the light transmitting panels, but also because of increased amounts of heat absorbed by the panel material by the passage of sunlight therethrough and transferred to the air in the greenhouse enclosure by convection as the air passes along the underside of the panels.

A further advantage resulting from the bowed arrangement of the panels is that a larger span of each panel between the supporting framing members is made possible, as compared to flat panels, due to the increased strength imparted to the panel by its bowed condition. Thus, not only larger unobstructed viewing areas are provided, but also less obstruction to the entry of sunlight is afforded. The bowed form of the panel sheet also makes it possible to use a simpler form of support for the panels, such as the grooved framing members described, as compared to the relatively complicated gripping or other attaching devices employed in conventional structures of this type. It will also be evident that the simplicity of the structure described lends itself to reduced labor and material costs due to a reduction in the number of parts required, the ease of assembly, and the fact that relatively thinner sheet material may be used for the panels.

An additional improvement afforded by the described arrangement is the aesthetically pleasing appearance of the overall building structure in which the bowed light transmitting panels are embodied.

Although the invention has been described mainly with reference to a circular greenhouse, other shapes and types of building structures are within the scope of the invention, such as rectangular, square, polygonal, oval or other shapes, including a composite of different shapes. Structures which may embody the invention are not limited to complete or free-standing buildings, but may comprise part-structures such as those appended or attached to other buildings of various types, as for example an enclosure constructed on a patio adjacent a house.

Accordingly, while the invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A building structure for a solarium or the like, comprising, in combination, a plurality of panels formed of stiff, outwardly bowed, transparent sheet members arranged adjacent one another in substantially radial array, and elongated spaced framing members extending along the adjacent sides of said panels holding said panels in bowed condition in said array, the form and arrangement of said panels being generally such that some portions of said panels are substantially normal to the rays of the sun as the position of the sun changes relative to said panels, thereby facilitating passage of the sun's rays through said transparent panels, said panels being generally triangular in flat form, said framing members formed with grooves along their length, said panels inserted along their side edges in said grooves, whereby said framing members firmly hold said panels in outwardly bowed position, the dimensions of said grooves in cross-section being sufficiently greater than the thickness of said panel edges to allow variation of the position of said panel side edges in said grooves along the length thereof, the opposite side walls of said grooves being convergent, said grooves being substantially triangular in cross-section, said panels having straight side edge portions inserted along their length in said grooves, said opposite side walls converging outwardly and holding said inserted panel edge portions in substantial sealing relation therewith.

2. A building structure as defined in claim 1, said array of panels forming a downwardly sloping roof.

3. A building structure as defined in claim 2, wherein the radius of curvature of said panels is substantially the same along their length.

4. A building structure as defined in claim 2, wherein the radius of curvature of said panels increases from the wide end toward the narrow end thereof.

* * * * *